United States Patent [19]

Jonsson

[11] 4,089,433

[45] May 16, 1978

[54] CLOSURE FOR A CONTAINER

[75] Inventor: Knut Jonsson, Kungalv, Sweden

[73] Assignee: AB Wicanders Korkfabriker, Alvangen, Sweden

[21] Appl. No.: 815,432

[22] Filed: Jul. 13, 1977

[30] Foreign Application Priority Data

Jul. 13, 1976 Sweden ..... 7607971

[51] Int. Cl.[2] ..... B65D 55/02; B65D 85/56; A61J 1/00

[52] U.S. Cl. ..... 215/218; 215/274

[58] Field of Search ..... 215/218, 274, 277

[56] References Cited

U.S. PATENT DOCUMENTS 3,572,532 3/1971 Shannon ..... 215/218

3,858,741 1/1975 Smith, Sr. ..... 215/218 X

*Primary Examiner*—George T. Hall

*Attorney, Agent, or Firm*—Brumbaugh, Graves, Donohue & Raymond

[57] ABSTRACT

A closure for an open topped container such as a bottle, having a radially outwardly projecting rim, in which an annular collar surrounds the rim and has an integrally formed sealing insert extending across its opening and connected thereto by rupturable bridge elements. An annular intermediate part surrounds the collar and is rotatable thereon. An internally threaded screw cap is threadable onto external screw threads on the intermediate part which can be held against rotation by means of a downwardly extending skirt portion.

6 Claims, 4 Drawing Figures

CLOSURE FOR A CONTAINER

The present invention relates to a closure for a container.

It is very often desirable to ensure that a closure for a container is not readily openable by children, particularly if the container is a bottle or the like for medicines, pills etc. Various forms of container closures of this type have been proposed in the past but these are relatively complex.

It is now proposed, according to the present invention, to provide a closure for an open-topped container having a radially outwardly projecting rim, said closure comprising an annular collar part, adapted to surround said rim, an intermediate part having an external thread and extending around said collar part and being rotatable thereon, a screw cap having an internal screw thread engaged on the screw thread of the intermediate part and means enabling the intermediate part to be held against rotation to permit said cap to be screwed onto or unscrewed from said intermediate part.

The means enabling the intermediate part to be held against rotation may comprise a downward extension of the intermediate part which extends below the screw cap. This can be a projecting tab at one individual point, but preferably it is a continuous skirt portion extending downwardly over the full periphery of the intermediate part so that it can be grasped at any point with the finger and thumb of one hand and the cap unscrewed with the other hand.

In order to increase the security against tampering by a child, the internal screw thread of the screw cap and/or the external screw thread of the intermediate part may be roughened e.g. by sand blasting.

In one particular construction according to the invention the collar part further comprises a radially outwardly and upwardly extending annular lip, which is positioned to seal against the screw cap when the latter is fully screwed on and serves as a pouring lip when the cap is removed.

It is often advantageous to provide a security seal so that a purchaser can determine whether or not a container has been opened prior to purchase. With the construction according to the invention, a security seal may be provided by the annular part having an integrally formed sealing insert extending across the central opening of the collar part, and having rupturable bridge elements connecting the sealing inserts to the collar part. This sealing insert will be preferably in the form of a disc held to the collar part by bridge elements.

In order that the invention may more readily be understood, the following description is given, merely by way of example, reference being made to the accompanying drawings, in which.

Figure 1:
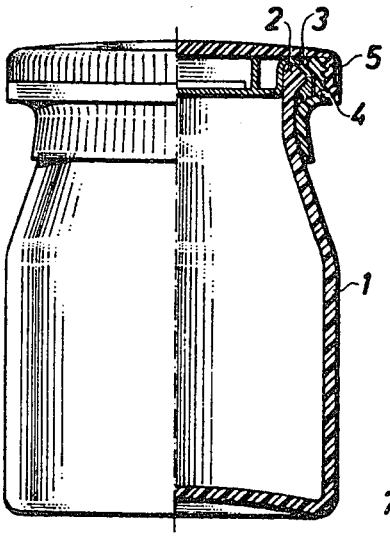
FIG. 1 is a side elevation, partly in section, of an open-topped container provided with one embodiment of closure according to the invention.
Figure 2:
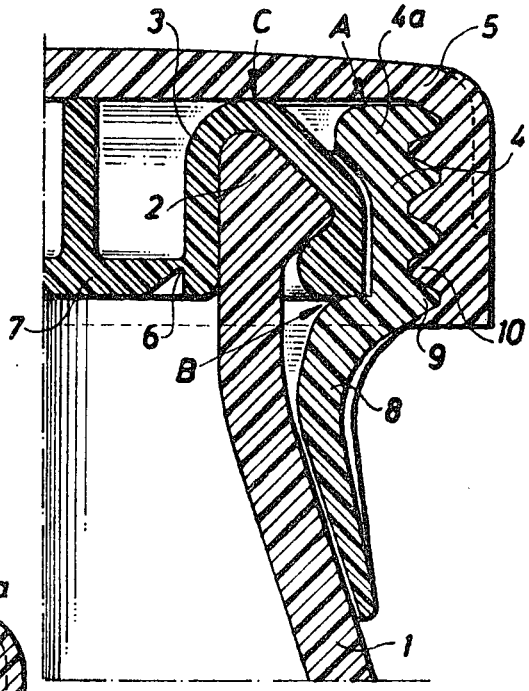
FIG. 2 is an enlarged sectional view of a portion of the closure and container of FIG. 1.

Referring first to FIG. 1 the container illustrated is in the form of a jar or bottle 1 having a radially outwardly projecting rim 2 adjacent the opening of the container. The closure according to the invention includes three main parts, that is a collar 3 surrounding the rim, an intermediate portion 4 extending around the collar 3 and being rotatable thereon, and an outer screw cap 5.

The collar part 3 is held relatively firmly around the rim of the opening of the container and is provided with a sealing or security insert 7 extending across the opening of the container, the insert being integrally formed with the collar and secured thereto by rupturable bridge elements 6. The firm connection of the collar parts 3 to the rim of the jar results in an extremely good sealing effect between the lid and the opening of the jar. The collar part is preferably held in contact with the intermediate part 4 at the point B with the cap 5 at the point C in order to achieve satisfactory sealing.

The intermediate part 4, which as indicated is rotatable on the outer surface of the collar 3, is provided with a downwardly extruding extension 8 in the form of a continuous skirt extending downwardly over the full periphery of the intermediate part 4. This skirt extends below the lower edge of the cap 5. The outer surface of the intermediate part 4 is provided with an external screw thread 9 and the cap 5 is provided with a cooperating internal screw thread 10. In order to achieve a good friction between the threads 9 and 10 these may be roughened, for instance by sand-blasting. Preferably a slight clearance A is left between the upper part 4*a* of the intermediate part 4 and the screw cap 5.

Figure 3:
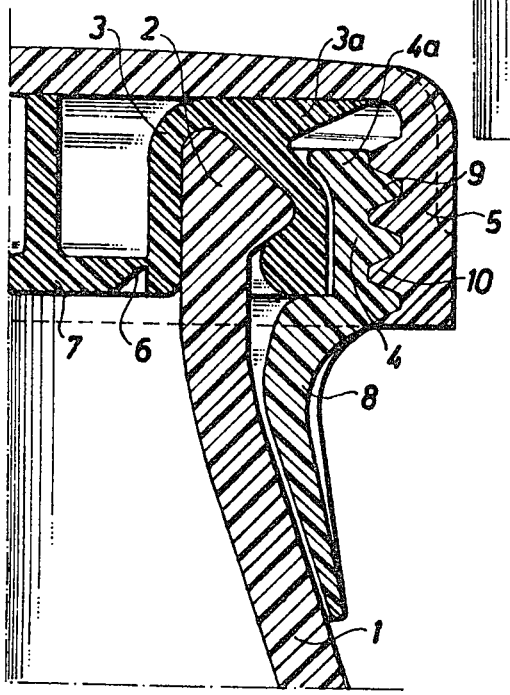
FIG. 3 is a view similar to FIG. 1 of a modified construction.
Figure 4:
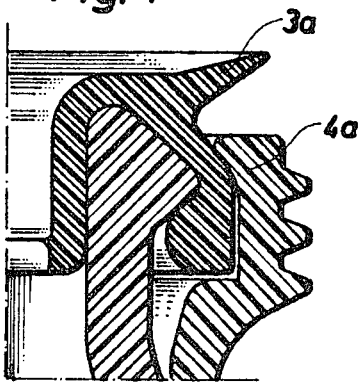
FIG. 4 is a further view of a construction of FIG. 3 showing the cap removed.

FIGS. 3 and 4 show a further embodiment of the collar part 3. This includes a radially outwardly and upwardly extending annular lip 3*a* which serves as a resilient sealing ring which seals against the screw cap when the latter is fully screwed on and serves as a pouring lip when the cap is removed, as shown in FIG. 4.

The closure according to the present invention functions as follows:

When applied the closure provides a security seal and also a child-proof closure. By security seal it is meant one in which, by a simple inspection, the consumer can ascertain whether the container has been opened or not by screwing off the cap 5 and checking to see whether the sealing insert 7 is still joined to the inner wall of the collar 3 or not. Since the collar 3 completely surrounds the rim 2 of the opening of the container, and is made in one piece with the sealing insert 7 by means of the bridge element 6, the collar provides an extremely tight seal to the container.

In order to be able to unscrew the lid 5 from the intermediate part 4, the latter must be temporarily secured in position. This can easily be achieved by holding the extension skirt, for instance by pressing it against the neck of the container with the thumb and forefinger of one hand, and the cap can then easily be screwed off in the normal manner, whereupon the sealing insert 7 can be removed by pulling out. Thereafter the closure only serves as a safety closure. Thus, in order to remove the lid 5 a person must hold the intermediate part 4 in one hand and carry out the unscrewing motion of the cap with the other hand. Experiments have indicated that such a combination of movements cannot readily be performed by a small child. Even if the closure is only used as a safety seal, a satisfactory sealing effect is achieved and a collar part 3 substantially completely encloses the rim of the jar opening, guaranteeing a good seal against the inside of the lid 5.

I claim:

1. A closure for an open-topped container having a radially outwardly projecting rim, said closure comprising an annular collar part adapted to surround said rim, an intermediate part having an external thread and extending around said collar part and being rotatable thereon, a screw cap having an internal screw thread engaged on the screw thread of the intermediate part and means enabling the intermediate part to be held against rotation to permit said cap to be screwed onto or unscrewed from said intermediate part.

2. A closure as claimed in claim 1, wherein said means enabling the intermediate part to be held against rotation comprises a downward extension of the intermediate part extending below the screw cap.

3. A closure as claimed in claim 2, wherein the downward extension comprises a continuous skirt portion extending downwardly over the full periphery of the intermediate part.

4. A closure as claimed in claim 1, and wherein said annular collar part further comprises an integrally formed sealing insert extending across the central opening portion of the collar part and rupturable bridging elements connecting said sealing insert to said collar part.

5. A closure as claimed in claim 1, wherein at least one of said internal screw thread on the screw cap and the external screw thread on the intermediate part is roughened.

6. A closure as claimed in claim 1, wherein the collar part further comprises a radially outwardly and upwardly extending annular lip, which is positioned to seal against the screw cap, when the latter is fully screwed on and serves as a pouring lip when the cap is removed.

* * * * *